US005285249A

United States Patent [19]

Mahoney

[11] Patent Number: 5,285,249

[45] Date of Patent: Feb. 8, 1994

[54] FINISHING APPARATUS FOR STAPLING SHEETS STACKED FIRST-TO-LAST OR LAST-TO-FIRST

[75] Inventor: Gregory P. Mahoney, Fairport, N.Y.

[73] Assignee: Eastman Kodak Company, Rochester, N.Y.

[21] Appl. No.: 943,094

[22] Filed: Sep. 10, 1992

[51] Int. Cl.[5] ..... G03G 21/00; B42B 2/00

[52] U.S. Cl. ..... 355/324; 270/53

[58] Field of Search ..... 355/318, 321, 324; 270/37, 53

[56] References Cited

U.S. PATENT DOCUMENTS

| | | | |
|---|---|---|---|
| 4,355,880 | 10/1982 | Stemmle . | |
| 4,384,782 | 5/1983 | Acquaviva . | |
| 5,005,751 | 4/1991 | Radtke et al. | 270/53 X |
| 5,022,637 | 6/1991 | Coons | 270/53 |
| 5,187,534 | 2/1993 | Iwata et al. | 355/324 |

FOREIGN PATENT DOCUMENTS

| | | | |
|---|---|---|---|
| 62-186278 | 8/1987 | Japan | 355/324 |
| 62-186279 | 8/1987 | Japan | 355/324 |
| 2-86552 | 3/1990 | Japan | 355/324 |

*Primary Examiner*—Fred L. Braun

*Attorney, Agent, or Firm*—Lawrence P. Kessler

[57] ABSTRACT

A finishing apparatus for use with a host reproduction apparatus to form properly collated sets of copies produced by the reproduction apparatus. The finishing apparatus includes first and second stapling units each having a stapler head and a clincher head for stapling an edge of a stack of copy sheets. The stapler head of the first stapling unit and the clincher head of the second stapler unit are located to a first side of a stack member supporting a stack of sheets, and the clincher head of the first stapling unit and the stapler head of the second stapling unit are located on a second and opposite side of the stack supporting member.

9 Claims, 2 Drawing Sheets

FINISHING APPARATUS FOR STAPLING SHEETS STACKED FIRST-TO-LAST OR LAST-TO-FIRST

BACKGROUND OF THE INVENTION

This invention relates in general to finishing apparatus for use with reproduction apparatus, and more particularly, to a finishing apparatus for properly collating and stapling sets of copy sheets produced by a reproduction apparatus.

Today's ever-increasing document information flow, in the form of paper documents, typically involves the reproduction of a series of ordered document pages on a reproduction apparatus. Such ordered document pages, as is well known, may be fed to the reproduction apparatus automatically using an automatic document recirculating feeder, or manually. The tendency with automatic document feeders is to feed an ordered set of document pages in a last-to-first (LTF) page order, while that with manual feeding is to feed the same set in a first-to-last (FTL) page order. It is also possible with an automatic document feeder, with manual feed, as well as with electronic data (for example, from a computer) to feed pages in either a first-to-last page order or last-to-first page order.

In either case, copy sheets of such document pages as disclosed, for example, in U.S. Pat. Nos. 4,134,672, issued Jan. 16, 1979 ((Burlew et al.); 4,462,681, issued Jul. 31, 1984 (Aerts et al.); and 5,080,340, issued Jan. 14, 1992 (Hacknauer et al.) are produced by, or exit, a reproduction apparatus in the order in which the ordered document pages were fed to the reproduction apparatus. Furthermore, depending on the overall capabilities of a particular reproduction apparatus, the copy sheets may be exiting the reproduction apparatus in an image-face up or an image-face down orientation. Proper collection and stapling of such copies exiting from a reproduction apparatus requires that a set of the exiting copies be arranged in a first-to-last (FTL) image order, front-to-back, and that the set be stapled in a front-to-back direction. Stapled as such, the crown of each staple is on the front of the stapled set, and the clinched stapled legs are to the backside of the stapled set.

SUMMARY OF THE INVENTION

It is an object of the present invention to provide a finishing apparatus for properly collating and stapling sets of copy sheets produced by a host reproduction apparatus.

In accordance with the present invention, a finishing apparatus provided for use with a reproduction apparatus includes a stack supporting member for supporting a stack of copy sheets, and a plurality of stapling units including a first stapling unit and a second stapling unit that each have a stapler head and a clincher head for stapling an edge of a stack of sheets on the stack supporting member. The stapler head of the first stapling unit and the clincher head of the second stapling unit are located to a first side of the stack supporting member, and the clincher head of the first stapling unit and stapler head of the second stapling unit are located to a second and opposite side of the stack supporting member.

BRIEF DESCRIPTION OF THE DRAWINGS

In the detailed description of the invention presented below, reference is made to the drawings, in which.

DETAILED DESCRIPTION OF THE INVENTION

Because electrostatographic reproduction apparatus and finishing apparatus for use therewith are well known, the present description will be directed in particular to elements of each apparatus which form part of or cooperate more directly with the present invention. Elements that are not specifically shown or described herein are assumed selectable from typical elements known in the prior art.

Figure 1:
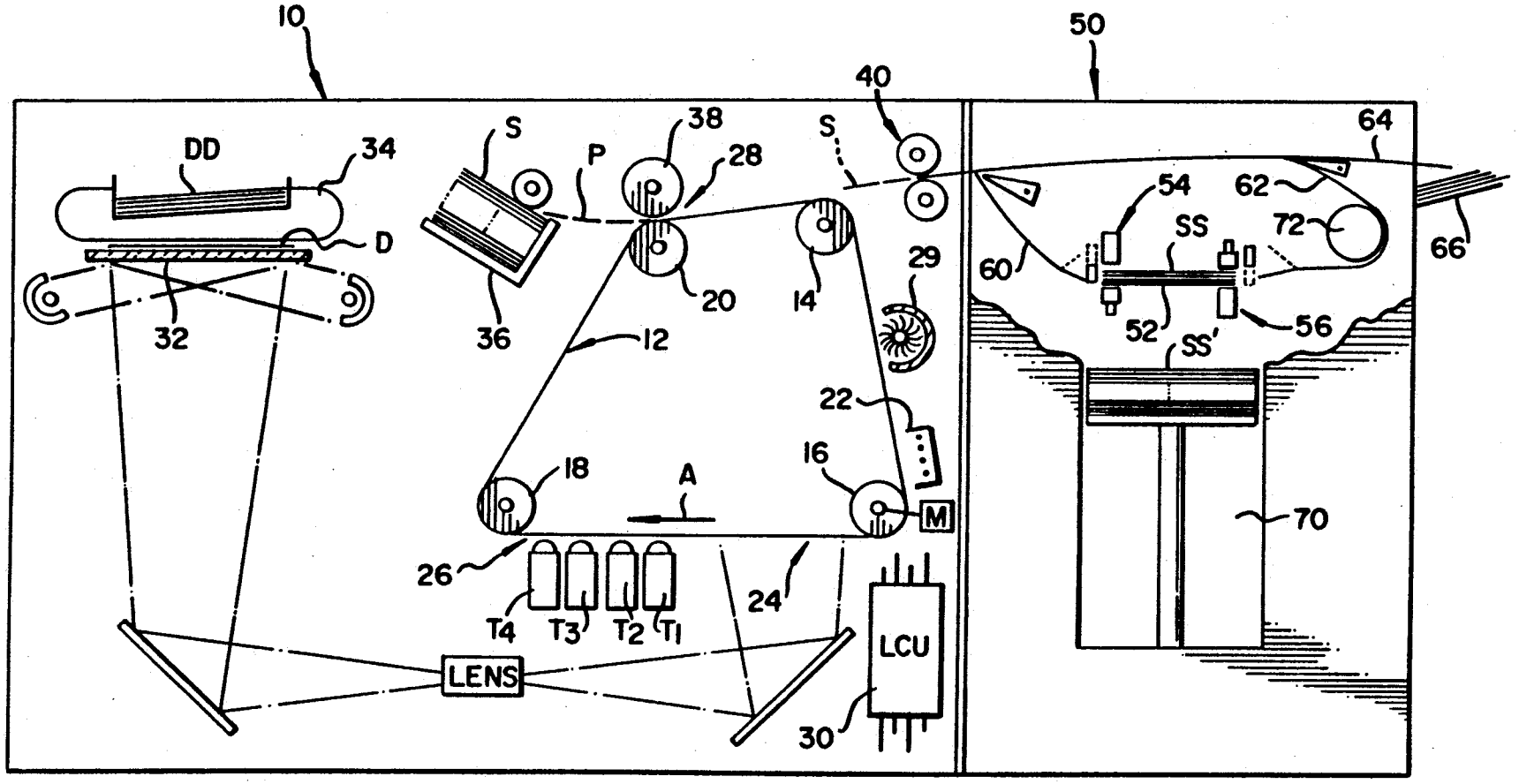
FIG. 1 is a schematic illustration of an exemplary electrostatographic reproduction apparatus including a tri-modial finishing apparatus according to this invention.

Referring now to the drawings, FIG. 1 schematically shows an exemplary electrostatographic reproduction apparatus 10, and a finishing apparatus, designated generally by the numeral 50, for use therewith according to the present invention. The exemplary reproduction apparatus 10 includes a dielectric, image carrying member 12 shown, for example, in the form of a flexible endless web. As is well known, the dielectric member 12 can also be a rotatable rigid drum. As shown, the web 12 is trained for movement in the direction of the arrow A about a series of rollers 14, 16, 18 and 20. One of these rollers, for example, the roller 16, is a drive roller coupled to a motor M for moving the web 12 about a closed loop path as shown.

As is well known, electrostatographic process stations shown as 22, 24, 26, 28 and 29 are located about the closed loop path in operative association with the web 12 under the control of a logic and control unit (LCU) 30.

The electrographic process, under control of the logic and control unit 30, functions as follows. The motor M is activated to move the dielectric member web 12 about its closed loop path in the direction of arrow A. A corona charger 22 applies a uniform electrostatic charge to the surface of the web 12 as it moves past the charger 22. In an information receiving area of the web, the uniform charge is altered at an exposure station 24 to form an image-wise latent image charge pattern corresponding to information to be copied. With the particular reproduction apparatus 10 illustrated, the charge pattern is formed, for example, by exposing the web 12 to a reflected light image of an original document D that is placed on a transparent platen 32. The original document D may be placed on the platen 32 manually or automatically by a recirculating document feeder 34. The document D, for example, is one sheet of an ordered set of document sheets DD which may be placed on the platen 32 for copying in a first-to-last (FTL) or a last-to-first (LTF) order for the set of sheets. As is well known, reproductions or copies of the set of documents DD will be formed by the reproduction apparatus 10 in the order in which the document sheets are placed on the platen for copying. Of course, other well known optical or electronic mechanism and methods may be utilized to expose or alter the uniform charge on the web 12 in an image-wise pattern corresponding to information to be reproduced. Such information can be in the form of a document set arranged in a first-to-last or last-to-first order of pages.

After the latent image charge pattern is formed on the web 12, that portion of the web bearing such image is brought into operative relation with a developer station 26. The developer station 26, for example, may include a plurality of magnetic brush development mechanisms 71, 72, 73, 74, transporting pigmented marking par into contact with web 12. The marking particles adhere to the latent image charge pattern on the surface of the web 12 to develop such image.

The developed image on the web 12 is thereafter brought, by continued web movement about the closed loop path, to a transfer station 28. Ordinarily, a receiver or copy sheet S is fed from a supply hopper 36 and transported along a path P to the transfer station 28 in timed relation with the moving web 12 so that the receiver or copy sheet S is in proper registration for receiving the developed image being transferred from the web. The receiver sheet here leaves the transfer station image face down. At the transfer station, an electrical field may be established to aid transfer of the marking particles of the developed image from the web 12 to the receiver sheet S directly, or initially to the surface of an intermediate transfer drum 38 before being transferred to a latter fed receiver sheet S. Initial transfer to the transfer drum 38 (before transfer to a sheet S) is carried out particularly when producing multicolor images. In such case, the receiver sheet leaves the transfer station 28 image face up. After transfer of the marking particles to the receiver sheet S, the receiver sheet S, now carrying the transferred image either image face up or face down, is stripped from the web 12 and transported to a fusing station 40 where the transferred image is fixed to the receiver sheet S by heat and/or pressure, for example, to form a sheet copy of the original document D. As shown, the fusing station 40 has two heated rollers suitable for fusing copy sheets reaching it image face up or down.

Meanwhile, the web 12 is moved through a cleaning assembly 29 where residual (non-transferred) marking particles and other debris remaining on the surface of the web are removed. The web 12 is thus conditioned for reuse in forming subsequent information reproductions.

Figure 2A:
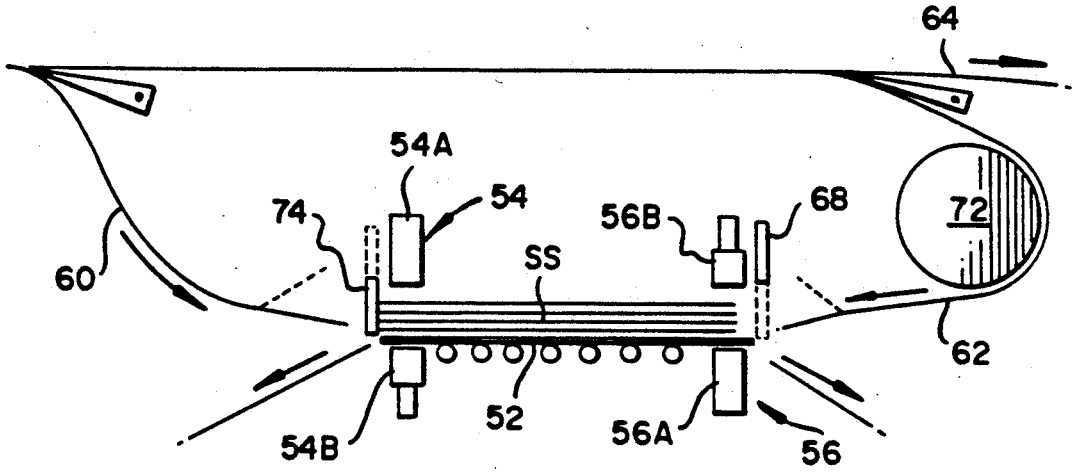
FIG. 2A is a schematic view, on an enlarged scale, of copy sheet transport paths and a stapling assembly of the finishing apparatus of the present invention.
Figure 2B:
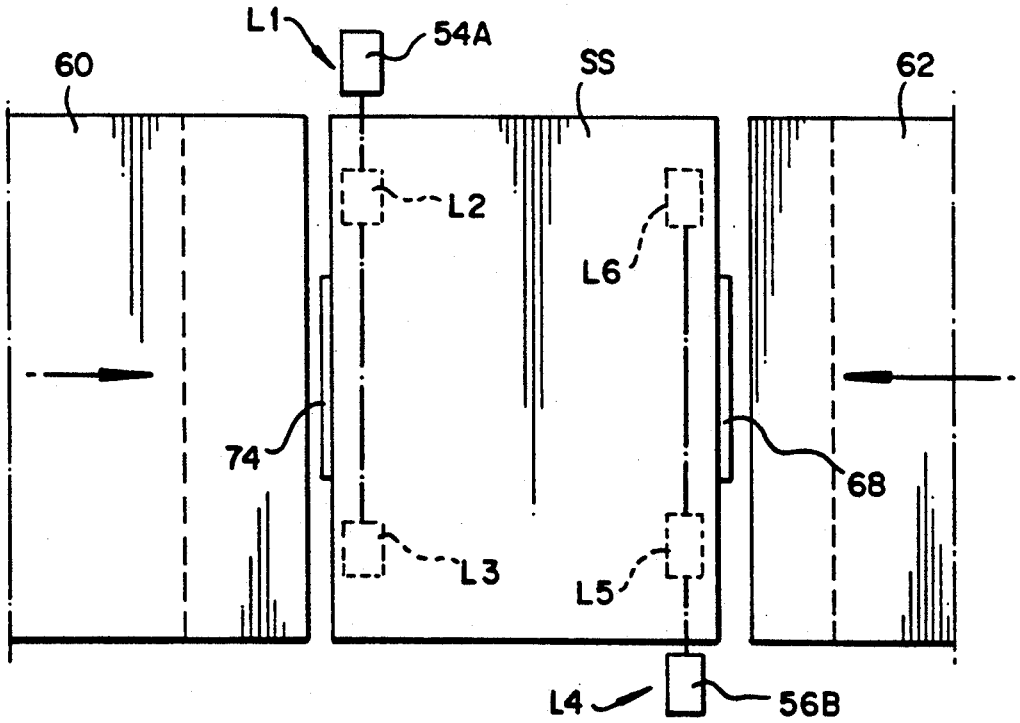
FIG. 2B is a top plan view of the stapling assembly of the present invention.

Referring now to FIGS. 1-2B, receiver or copy sheets S from the fusing station 40 exit the reproduction apparatus 10 into the finishing apparatus 50 of the present invention where they are properly collated in a first-to-last (FTL) sheet order, and stapled correctly front-to-back. As pointed out above, depending on the manner and order in which the set of ordered document pages DD were fed to the reproduction apparatus 10, the exiting copies may be entering the finishing apparatus 50 in a first-to-last (FTL) or last-to-first (LTF) image copy order, and with the image face up or down.

As shown, the finishing apparatus 50 comprises a stack supporting member 52 for supporting a stack of an ordered set of copy sheets SS to be stapled. The finishing apparatus 50 also includes a plurality of stapling units including a first stapling unit 54 and a second stapling unit 56 which each have a stapler head and a clincher head 54A, 54B and 56A and 56B (FIG. 2A), respectively. The stapling units 54, 56 are useful for stapling an edge of a stack SS of copy sheets supported on the stack supporting member 52. As further shown (FIGS. 1, 2A), the first stapling unit 54 and second stapling unit 56 are located oppositely from each other relative to the stack supporting member 52. As such, the stapler head 54A of the first unit 54, and the clincher head 56B of the second unit 56 are located to a first side (to top side) of the stack supporting member 52. Meanwhile, the clincher head 54B of the first unit 54, and the stapler head 56A of the second unit 56 are located to a second and opposite side (the bottom side) of the supporting member 52.

The finishing apparatus 50 also has means including a first sheet transport path 60, and a second sheet transport path 62 for moving and feeding seriatim onto the stack supporting member 52, image carrying copy sheets exiting the reproduction apparatus 10. The finishing apparatus 50 also includes a third sheet transport path 64 for transporting similar copy sheets in loose form to an output tray 66.

In accordance with the present invention a first type of a set of copy sheets which exit the reproduction apparatus image-side up, and in a LTF (last-to-first) image order, as well as a second type of a set of copy sheets which exit the reproduction apparatus image-side down, and in an FTL (first-to-last) image order, are fed along the first transport path 60 into a FTL (first-to-last) image ordered stack on the supporting member 52. Copy sheets of the first type are fed along the path 60 into a registered stop against a first removable stop means 68 with the last sheet of the set at the bottom of the stack and the first sheet thereof at the top of the stack. The edge of the stack to be stapled should lie under the first stapler head 54A which can then drive a staple in a top-to-bottom, i.e., a front-to-back direction of the stack, where the staple legs are clinched by the clincher head 54B thereof. On the other hand, copy sheets of the second type are fed similarly along the path 60 against the stop 68 with the first sheet of the set at the bottom and the last sheet thereof at the top of the stack. The edge of the stack to be stapled should be over the stapler head 56A of the second stapling unit 56 which can then drive a staple in a bottom to top or front to back direction of the stack, where the staple legs are clinched by the clincher head 56B thereof. Sets of sheets SS' stapled as such can then be removed by any suitable means for accumulation in an output hopper shown as 70 (FIG. 1).

Furthermore, in accordance with the present invention, a third type of a set of copy sheets which exit the reproduction apparatus image-side down, and in a last-to-first (LTF) image order, as well as a fourth type of a set of copy sheets which exit the reproduction apparatus image-side up, and in a first-to-last (FTL) image order, are fed by the second transport path 62 into a FTL (first-to-last) image ordered stack on the stack supporting member 52. As such, copy sheets of the third type (which are image-side down) are fed along the second transport path 62 around a sheet-side inverting device 72 so that they arrive the stack supporting member image-side up. They are moved into a registered stop against a second removable stop means 74 with the last image sheet of the set (which came in first) at the bottom of the stack being formed and the first sheet thereof at the top of the stack. The edge of the stack to be stapled should be under the stapler head 54A of the first stapling unit 54 which can then drive a staple in a top-to-bottom, i.e., a front-to-back direction of the stack. The legs of the driven staple can then be clinched to the bottom or back of the stack by the clincher head 54B thereof.

On the other hand, copy sheets of the fourth type which exit the reproduction apparatus image-side up and in an FTL order, are also fed along the second path 62 over the inverting device 72 so that they arrive the supporting member 52 image-side down. They are moved into a registered stop against the removable stop member 74 with the first image sheet of the set (which arrived first) at the bottom of the stack being formed, and the last image sheet thereof at the top of the stack. The edge of the stack to be stapled should be the stapler head 56A of the second stapler unit 56 which can then drive a stapler in a bottom-to-top, i.e., a front-to-back direction of the stack. The legs of the driven staple are then clinched to the top or back of the stack by the clincher head 56B thereof.

As shown in FIG. 2B, the first and second stapling units 54 and 56, respectively, may each be movable along their respective and opposite edges of a stack of sheets SS. For example, the first stapling unit 54 which has the stapler head 54A may be movable from a home and out-of-the-way position L1, through two stapling positions L2 and L3. Similarly, the second stapling unit 56 which has a clincher head 56B may be moved from a home and out-of-the-way position L4, through two stapling positions L5 and L6. Portions of the transport paths 60 and 62 adjacent the supporting member 52 may be mounted so as to pivot out of the way in order to allow for a stapled stack of sheets to be unloaded from the supporting member 52.

It is understood that the finishing apparatus of the present invention is equally useful with a reproduction apparatus capable of producing duplex copies in a duplex mode. Accordingly, in the duplex mode, the "image side" of significance for purposes of the present invention becomes the "first-image side" relative to the second image side of a duplex copy.

As can be seen, a finishing apparatus 50 has been provided that is capable of properly collating and stapling four different types of sets of copy sheets which exit a reproduction apparatus image-side up or down, and in a first-to-last or last-to-first image order. The finishing apparatus 50 includes sheet transport means and stapling means for properly collating such copy sheet in a first-to-last image order, and for properly stapling a stack thereof in a front-to-back direction.

The invention has been described in detail with particular reference to a preferred embodiment thereof, but it will be understood that variations and modifications can be effected within the spirit and scope of the invention.

What is claimed is:

1. A finishing apparatus for use with a host reproduction apparatus, the finishing apparatus comprising:

(a) means for supporting a set of copy sheets;

(b) means for feeding copy sheets seriatim into a stack on said supporting means;

(c) a first stapling unit associated with said supporting means for stapling an edge of a stack of copy sheets on said supporting means, said first stapling unit having a first stapler head on a first side of said supporting means, a first clincher head on a second and opposite side of said supporting means; and (d) a second stapling unit associated with said supporting means for stapling an edge of a stack of copy sheets on said supporting means, said second stapling unit having a second stapler head located on said second side of said supporting means, and a second clincher head located on said first side of said supporting means.

2. A finishing apparatus for use with a host reproduction to form properly collated and stapled sets of copies produced by the reproduction apparatus, the finishing apparatus comprising:

(a) a stack supporting means for supporting a stack of copy sheets; and (b) a plurality of stapling units including a first stapling unit and second stapling unit each having a stapler head and a clincher head for stapling an edge of a stack of copy sheets on said stack supporting means, wherein the stapler head of said first stapling unit and the clincher head of said second stapling unit are located with respect to a first side of said stack supporting means, and the clincher head of said first stapling unit and the stapler head of said second stapling unit are located with respect to a second unit are located with respect to a second and opposite side of said stack supporting means.

3. The finishing apparatus of claim 2 including a sheet transport path along which first and second types of image carrying copy sheets exiting a host reproduction apparatus are fed seriatim onto said supporting means, a first type of copy sheet exiting the host reproduction apparatus image side up and in a last-to-first (LTF) image order, and a second type exit image side down and in a first-to-last (FTL) image order.

4. The finishing apparatus of claim 3 wherein copy sheets of said first type are stapled by said first stapling unit, and copy sheets of said second type are stapled by said second stapling unit.

5. The finishing apparatus of claim 3 including a second sheet transport path, distinct from said first mentioned sheet transport path, along which third and fourth types of image carrying copy sheets exiting a host reproduction apparatus are fed seriatim onto said supporting means, said third type of copy sheet exiting the reproduction apparatus image side down and in a last-to-first (LTF) image order, said fourth type exiting image side up and in a first-to-last (FTL) image order.

6. The finishing apparatus of claim 5 including means along said second sheet transport for inverting copy sheets being fed onto said supporting means.

7. The finishing apparatus of claim 6 wherein copy sheets of said third type are stapled by said first stapling unit, and copy sheets of said fourth type are stapled by said second stapling unit.

8. The reproduction apparatus of claim 6 including a third sheet transport path for feeding seriatim, into an output tray, copy sheets of said first and second types.

9. A reproduction apparatus comprising:

(a) means for producing seriatim, on a set of copy sheets, copies of an ordered set of original images in a last-to-first (LTF) image copy order, or in a first-to-last (FTL) image copy order; and (b) a finishing apparatus for stapling said set of copy sheets into a collated first-to-last order, said finishing apparatus including:

(i) means for supporting said set of copy sheets;

(ii) means for feeding copy sheets seriatim onto a stack on said supporting means;

(iii) a first stapling unit associated with said supporting means for stapling an edge of a stack of copy sheets on said supporting means, said first stapling unit having a first stapler head located on a first side of said supporting means, and a first clincher head located on a second and opposite side of said supporting means; and (iv) a second stapling unit associated with said supporting means for stapling an edge of a stack of copy sheets on said supporting means, said second stapling unit having a second stapler head on said second side of said supporting means, and a second clincher head on said first side of said supporting means.

* * * * *